US009127663B2

(12) United States Patent
Pegg et al.

(10) Patent No.: US 9,127,663 B2
(45) Date of Patent: Sep. 8, 2015

(54) FLUID HEATING APPARATUS AND METHOD

(71) Applicant: Ford Global Technologies, LLC, Dearborn, MI (US)

(72) Inventors: Ian Graham Pegg, Chelmsford (GB); Roland Paul Stark, Hitchin (GB)

(73) Assignee: Ford Global Technologies, LLC, Dearborn, MI (US)

( * ) Notice: Subject to any disclaimer, the term of this patent is extended or adjusted under 35 U.S.C. 154(b) by 153 days.

(21) Appl. No.: 13/899,636

(22) Filed: May 22, 2013

(65) Prior Publication Data

US 2014/0003967 A1 Jan. 2, 2014

(30) Foreign Application Priority Data

Jun. 29, 2012 (GB) ..... 1211632.3

(51) Int. Cl.

| | |
|---|---|
| ***F01M 5/00*** | (2006.01) |
| ***F04B 39/06*** | (2006.01) |
| ***F04B 23/00*** | (2006.01) |
| ***F04B 53/08*** | (2006.01) |

(52) U.S. Cl.

CPC ..... *F04B 39/06* (2013.01); *F04B 23/00* (2013.01); *F04B 53/08* (2013.01)

(58) Field of Classification Search

USPC ..... 123/196 R, 196 AB; 184/104.1, 104.2

See application file for complete search history.

(56) References Cited

U.S. PATENT DOCUMENTS

| | | | | |
|---|---|---|---|---|
| 4,393,824 | A * | 7/1983 | Fischer et al. | 123/196 AB |
| 4,434,934 | A * | 3/1984 | Moser et al. | 237/12.3 R |
| 4,487,571 | A | 12/1984 | Robertson et al. | |
| 5,683,031 | A | 11/1997 | Sanger | |
| 2002/0008151 | A1 | 1/2002 | Moroi et al. | |
| 2006/0065217 | A1 * | 3/2006 | Ikegawa | 123/41.42 |
| 2008/0185453 | A1 | 8/2008 | Sanger et al. | |

FOREIGN PATENT DOCUMENTS

| | | | |
|---|---|---|---|
| JP | 1181962 | A | 3/1999 |
| JP | 2004132294 | A | 4/2004 |

OTHER PUBLICATIONS

Search Report Under Section 17 for Application No. GB1211632.3, 1 page, dated Oct. 3, 2013.

* cited by examiner

*Primary Examiner* — Hung Q Nguyen

(74) *Attorney, Agent, or Firm* — Greg Brown; Price Heneveld LLP

(57) ABSTRACT

An apparatus for heating a fluid such as engine oil includes an auxiliary pump, a conduit connected to the auxiliary pump and provides fluid communication from the auxiliary pump and an aperture in the conduit. In use the auxiliary pump contains the fluid. A first portion of the fluid is pumped into the conduit by the auxiliary pump and a second portion of the fluid remains in the auxiliary pump. The aperture restricts the flow of the first portion of the fluid in the conduit. The second portion of the fluid is heated due to friction between the second portion of the fluid and the pump. There is also described a method of heating a fluid.

20 Claims, 2 Drawing Sheets

FLUID HEATING APPARATUS AND METHOD

FIELD OF THE INVENTION

The invention generally relates to internal combustion engines that are widely used in cars, and more particularly to an apparatus and method of heating a fluid such as engine oil used in the engine.

BACKGROUND OF THE INVENTION

Improving the efficiency of any internal combustion engine can help to reduce the fuel consumption of the engine and thereby reduce running costs and the cost to the environment from harmful engine emissions. Many fuel efficiency measures have been developed recently but most of these concentrate on the way fuel is delivered to the engine and maximizing the work done by the fuel supplied to the engine. Other measures can however be taken to reduce the strain placed on the engine, for example in a car, limiting the speed of acceleration or increasing gear ratios at higher speeds.

Internal combustion engines use oil to lubricate the moving parts of the engine, reducing the friction between these parts and thereby increasing the working life of the moving parts. As the temperature of the oil increases, the oil becomes thinner and so provides the moving parts with less physical protection but at these increased temperatures, typically 60 to 80° C., additives in the oil start are activated and provide the necessary protection. These additives include anti-wear additives that are laid down on the internal surfaces of the engine at its components at 60° C. and hotter. The oil is also used to help cool components of the engine.

The temperature of the oil must be controlled, in particular to control the viscosity of the oil and so also its effectiveness to properly lubricate the moving parts of the engine. It is known that an engine whose parts, in particular the moving parts, are warm, and is more fuel efficient and the moving parts are less susceptible to damage.

The temperature of the oil in a hybrid vehicle can be a particular problem. A hybrid engine is designed to be efficient and as such generates less heat than a conventional engine. The temperature of the oil in a hybrid engine may therefore not be high enough to ensure the engine runs efficiently.

The oil in an internal combustion engine is normally heated by the engine itself but it is known to separately heat the oil using a conventional heater. This conventional type of heater may be a heating rod or plug that directly heats the oil. This is a relatively simple and therefore cost effective method of heating the oil but there are disadvantages. The rod or plug must be hot enough to transfer enough heat to the oil to raise the temperature of the oil in a reasonable period of time, but then the rods or plugs may cause the oil to burn when in contact with the rods or plugs. This may damage the composition of the oil and may be a potential source of fire.

In an alternative solution, a primary and secondary circuit is used. Water in the secondary circuit is used to heat oil in the primary circuit. In a further alternative solution, oil in a chamber is heated using heat provided by the exhaust gases from the engine.

It is desirable to provide an alternative way to heat the oil in an internal combustion engine.

SUMMARY OF THE INVENTION

According to one aspect of the present invention, an apparatus is provided for heating a fluid. The apparatus includes an auxiliary pump, a conduit connected to the auxiliary pump and providing fluid communication from the auxiliary pump, and an aperture in the conduit. The auxiliary pump contains the fluid, a first portion of the fluid is pumped into the conduit by the auxiliary pump and a second portion of the fluid remains in the auxiliary pump. The aperture restricts the flow of the first portion of the fluid in the conduit. The second portion of the fluid is heated due to friction between the second portion of the fluid and the auxiliary pump.

According to another aspect of the present invention, an apparatus for heating engine oil circulating in an engine is provided. The apparatus includes an auxiliary pump and a conduit in fluid communication with the auxiliary pump and having a fluid restrictor. The apparatus further includes engine oil pumped by the auxiliary pump in the conduit such that a first portion pumps into the conduit and a second portion remains in the auxiliary pump and is heated due to friction between the second portion and the auxiliary pump.

According to a further aspect of the present invention, a method of heating a fluid is provided. The method includes the steps of supplying the fluid to an auxiliary pump, pumping a first portion of the fluid into a conduit having an aperture restricting flow of the first portion of the fluid in the conduit, and circulating a second portion of the fluid that remains in the auxiliary pump because the aperture restricts the flow of the first portion of the fluid in the conduit. The second portion of the fluid is heated in the auxiliary pump due to friction between the second portion of the fluid and the auxiliary pump.

These and other aspects, objects, and features of the present invention will be understood and appreciated by those skilled in the art upon studying the following specification, claims, and appended drawings.

DETAILED DESCRIPTION OF THE PREFERRED EMBODIMENTS

Figure 1:
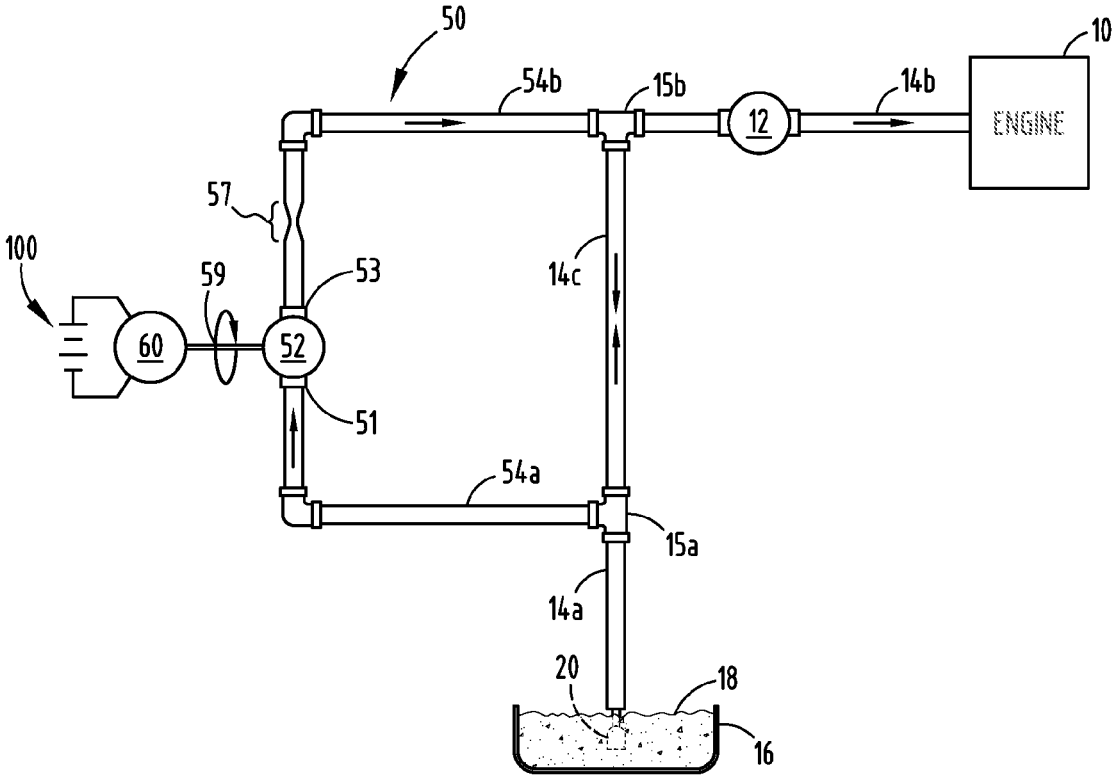
FIG. 1 is a schematic drawing of an apparatus for heating a fluid in accordance with one embodiment with the auxiliary pump positioned before the main oil pump of an engine.

As required, detailed embodiments of the present invention are disclosed herein; however, it is to be understood that the disclosed embodiments are merely exemplary of the invention that may be embodied in various and alternative forms. The figures are not necessarily to a detailed design; some schematics may be exaggerated or minimized to show function overview. Therefore, specific structural and functional details disclosed herein are not to be interpreted as limiting, but merely as a representative basis for teaching one skilled in the art to variously employ the present invention.

An apparatus for heating a fluid is described herein. The apparatus includes a first or auxiliary pump, a conduit connected to the auxiliary pump and providing fluid communication from the auxiliary pump, and an aperture in the conduit. In use the auxiliary pump contains the fluid, a first portion of the fluid is pumped into the conduit by the auxiliary pump and a second portion of the fluid remains in the auxiliary pump, the aperture restricting the flow of the first portion of the fluid in the conduit. The second portion of the fluid is heated due to friction between the second portion of the fluid and the auxiliary pump.

The fluid may a liquid. The fluid is normally oil and typically engine oil according to one embodiment. The oil may be either petroleum-based or synthetic. The engine oil may be used to lubricate the moving parts of an internal combustion engine. The apparatus for heating may be part of an internal combustion engine and/or a component part of an internal combustion engine. It may be an advantage that by warming the engine oil the efficiency of the internal combustion engine can be increased. The efficiency of the engine may refer to fuel efficiency and therefore to the engine using less fuel to produce the same power output.

The friction may be between the second portion of the fluid and internal surfaces and/or components of the auxiliary pump. The internal components may be one or more of an impeller, volute chamber, face plate, inlet port, outlet port and pump body. Warming and/or heating the fluid will be understood to mean that the temperature of the fluid is raised and/or increased. The first portion of the fluid may act against the aperture, the aperture thereby restricting the flow of the first portion of the fluid in the conduit.

The internal combustion engine may have an oil pump or second pump whose primary function is to circulate engine oil around the engine and/or to lubricate the moving parts. Commonly, the oil pump accounts for a significant proportion of the energy demand of an engine. The oil pump must be sufficiently sized to pump the oil around the engine at an adequate flow rate whilst maintaining an acceptable oil pressure. These conditions are most difficult to satisfy when the engine is at hot idle. It is important that the demands of an engine at hot idle are met but the proportion of time the engine spends in this state during a normal run cycle is relatively low.

The auxiliary pump of the apparatus for heating a fluid according to one embodiment may be used to both heat the fluid and pump the fluid around the engine. The auxiliary pump of the apparatus for heating a fluid according to one embodiment may be used to supplement the function of the oil pump when required. The size of the oil pump may therefore be reduced to match the most common level of demand placed on the oil pump, any demand in excess of this level being provided by the auxiliary pump of the apparatus. Reducing the size of the oil pump reduces the oil pump's energy demand and therefore may reduce the engine's overall fuel consumption, thereby increasing the engine's fuel efficiency.

The oil pump and auxiliary pump according to one embodiment may operate simultaneously (at the same time) to move and heat the engine oil. Alternatively the oil pump and auxiliary pump may operate independently. This may mean that the flow of oil around the engine and heating provided by the auxiliary pump may be separately controlled.

The auxiliary pump may be powered or operated by a motor. The auxiliary pump may be powered or operated by an electric motor. The electric motor may be connected to the auxiliary pump by a drive shaft. The electric motor may be used to turn the drive shaft and so also the auxiliary pump. Using an electric motor to run the auxiliary pump may mean that any surplus or excess electricity produced, by for example an alternator or other generator of electricity, can be used to heat and/or pump the oil. This reduces the demand for power from the engine because the engine is not required to mechanically pump the oil. This may improve the efficiency of the engine and so may reduce fuel consumption.

In an alternative embodiment the pump may be powered by a hydraulic motor. The auxiliary pump may have a fixed or variable displacement that is the volume of fluid displaced or pumped by the pump may be a fixed volume per unit time or the volume may be variable. The variability may be achieved by varying the speed of the motor running the pump.

Typically the auxiliary pump is less than 100% efficient and so some of the work imparted on the fluid by the auxiliary pump is translated into heat, not fluid flow. This heat is desirable and the auxiliary pump and/or motor may be adjusted to reduce the efficiency of the auxiliary pump to thereby provide the desired heating.

The auxiliary pump may be hydraulically inefficient. The auxiliary pump may be particularly inefficient when pumping fluid from low pressure to high pressure. Some of the fluid in the auxiliary pump may remain in the pump after one revolution or cycle of the auxiliary pump. Normally from 20 to 80%, typically from 60 to 40% of the fluid in the auxiliary pump may remain in the auxiliary pump after one revolution. The temperature of the fluid remaining in the auxiliary pump may be greater than the temperature of the fluid outside the auxiliary pump.

The apparatus for heating may be part of a hybrid vehicle and may be part of a hybrid electric vehicle. The hybrid electric vehicle may combine an internal combustion engine and electric propulsion system. The electricity to operate the electric propulsion system may be generated by the vehicle's internal combustion engine. Alternatively the electricity to operate the electric propulsion system may be generated by an electrical generator that converts the vehicle's kinetic energy into electricity. Alternatively the electricity to operate the electric propulsion system may be generated by an external generator, for example a power station, and the electricity stored in the vehicle battery or batteries.

The electric motor may be operated using electricity that has been produced by a hybrid vehicle or an external source of electricity. The electric motor may be operated using electricity stored in the vehicle battery. The vehicle battery may be charged, that is supplied with electricity, by a battery management system and/or battery charge controller. The battery management system and/or battery charge controller may control when the battery is charged and/or when load, that is the demand for electricity is placed on, for example the alternator, to charge the battery. The load may intentionally be during deceleration of the vehicle. The kinetic energy of the vehicle available during deceleration may be used to charge the battery and/or generate electricity.

The kinetic energy of the vehicle may be used to turn a flywheel that may continue to turn when the kinetic energy of the car has reduced. In an alternative embodiment electrical energy may be used to turn the flywheel. The flywheel may provide a store of energy. The kinetic energy in the flywheel may be directly used to power the auxiliary pump, using for example a drive shaft. The kinetic energy in the flywheel may be converted into electricity and used to power the electric motor connected to the auxiliary pump.

The inventors of the present invention have found that using a heating element to heat engine oil, commonly causes the engine oil to burn rather than only to be heated. If however the heating element is used such that the risk of burning the oil is reduced, that is the heating element heats the oil very slowly, the rate of heating is too slow to be useful.

Heating the engine oil reduces its viscosity. The viscosity of the oil when cold, for example at 0° C., may be 460 $mm^2$/sec. The viscosity of the oil when warm, for example at 90° C., may be 12 $mm^2$/sec.

The type and viscosity of the engine oil is typically chosen to protect the engine when the engine is cold, during warm up and when it is hot. Whilst pre-heating the engine oil in isolation might mean the engine is not adequately protected, it is intended that the oil is heated at a rate such that the warm oil helps to warm the engine. The quicker the engine can be heated from cold to a warm and optimum working temperature, the less time the engine will operate at a reduced efficiency or at less than optimum efficiency. The optimum working temperature of the engine may be from 80° C. to 120° C. If the moving parts of an engine are warm, the engine is typically more fuel efficient and if the oil contains anti-wear additives, the moving parts are less susceptible to damage.

Typically the oil pump accounts for from 5 to 10% of the overall fuel consumption of a cold engine. This is because the more viscous the oil, the more difficult it is to pump and the more power from the engine the auxiliary pump consumes. The apparatus for heating a fluid may reduce the viscosity of the oil more quickly after a cold start compared to a conventional engine and therefore reduce the overall fuel consumption and increase fuel efficiency over a typical run cycle.

Reducing the viscosity of the engine oil may reduce the friction between the engine oil and the component parts in contact with the engine oil. Reducing the friction may reduce how hard the engine needs to work to pump the oil around the engine at the required pressure and therefore may reduce fuel consumption. To increase the temperature of the oil, the oil may be worked. When the oil is pumped it is worked.

The aperture may be a restriction in the conduit. At a given velocity and viscosity of oil, the restriction may reduce the flow rate of the oil in the conduit. The restriction may provide the auxiliary pump with work to do. That is the auxiliary pump must pump the oil against a backpressure of oil in the conduit. The backpressure may be determined by the ratio of the diameter of an opening in the restriction to the internal diameter of the conduit. The lower the ratio, that is the smaller the diameter of the opening relative to the internal diameter of the conduit, the greater the backpressure. Increasing the backpressure may, under a similar velocity and viscosity of oil, increase the work done on the oil by the auxiliary pump and/or the time the first portion of oil spends in the auxiliary pump and therefore increase the temperature of the oil.

The opening may be circular or any other suitable shape, for example square. The size of the opening, in the case of a circular opening the diameter, may be fixed or variable. To control the backpressure in the conduit the size of the opening may be changed.

The aperture may be a section of the conduit having a reduced internal diameter. The section of the conduit may be from 2 mm to 5 mm in length and have an internal diameter that is from 20% to 80% of the internal diameter of the rest of the conduit. The internal diameter of the aperture may be from 10 mm to 20 mm. In further alternative embodiments the aperture may be one or more of a throttle plate, a disk or orifice plate.

There may be a pressure and/or temperature increase across the auxiliary pump. The pressure and/or temperature of the oil at a pump outlet may be higher than the pressure and/or temperature of the oil at a pump inlet.

The size of the opening may be fixed and speed of the auxiliary pump changed to control the backpressure and therefore the work done on the oil. The auxiliary pump may have a fixed or variable flow rate. The flow rate may be controlled by adjusting the speed of the auxiliary pump, that is the speed the pump turns or revolutions per minute (rpm). The rpm of the pump may be varied typically from 500 rpm to 6000 rpm.

By controlling the speed of the auxiliary pump and/or controlling the size of the opening in the aperture, the time the oil spends in the auxiliary pump and so also the backpressure of the oil in the conduit is thereby controlled.

The auxiliary pump may also be a heat store. The auxiliary pump may be heated by the warm oil. The heat from the auxiliary pump may be transferred to cool oil entering the auxiliary pump via the pump inlet. This heat store is useful because it can help to preheat oil entering the pump before the oil is heated by the action of the auxiliary pump.

A method of heating a fluid is also provided. The method including the steps of supplying the fluid to an auxiliary pump, pumping a first portion of the fluid into a conduit, the conduit having an aperture therein, the aperture restricting the flow of the first portion of the fluid in the conduit, and circulating a second portion of the fluid in the auxiliary pump, the second portion of the fluid remaining in the auxiliary pump because the aperture restricts the flow of the first portion of the fluid in the conduit. The second portion of the fluid is heated in the auxiliary pump due to friction between the second portion of the fluid and the auxiliary pump.

It may be an advantage that the auxiliary pump moves and heats the fluid. The fluid may be supplied to the auxiliary pump through a pump inlet. The fluid may be pumped through an outlet of the auxiliary pump into the conduit. The temperature of the fluid before heating may be less than or equal to 20° C. The temperature of the fluid after warming may be from 40° C. to 100° C., normally from 60° C. to 80° C.

The fluid may be oil. The oil may be used as a lubricant in an internal combustion engine. The method may include the step of using an oil pump whose primary function is to circulate the oil around the engine and/or to lubricate moving parts of the engine. The auxiliary pump typically pumps more oil, a greater volume of oil, compared to the oil pump whose primary function it is to circulate the oil around the engine. The auxiliary pump typically pumps oil at the same or a greater flow rate compared to the oil pump whose primary function it is to circulate the oil around the engine. Features of the method may be incorporated into the apparatus and vice versa.

Referring to FIG. 1, an engine 10, oil pump 12 and sump 16 containing oil 18 are shown according to one embodiment. The oil pump 12 is connected to the engine 10 by pipes 14*a* and 14*b*. The oil pump 12 is mechanically driven by the engine 10. A strainer 20 at the end of the pipe 14*a* in the sump 16 reduces the uptake of solid particles (not shown) by the oil pump 12 from the sump 16.

The pipe or conduit 14*a* has two T-piece connectors 15*a* and 15*b* along its length between the strainer 20 and the oil pump 12. A conduit 54*a* connects the T-piece connector 15*a* and an inlet 51 of an auxiliary pump 52. A conduit 54*b* connects the T-piece connector 15*b* and an outlet 53 of the auxiliary pump 52. There is a restriction 57 in the conduit 54*b* shown as a reduced size (e.g., diameter) aperture between the auxiliary pump 52 and the T-piece connector 15*b*.

The auxiliary pump 52 is a first pump that is powered by an electric motor 60. The auxiliary pump 52 and electric motor 60 are connected by a drive shaft 59. The auxiliary pump 52 is thereby electrically driven.

In use, the oil pump 12 is a second pump that pumps oil 18 from the sump 16, along pipes 14*a* and 14*b* to the engine 10 where the oil is circulated to lubricate the moving parts (not shown). When the oil 18 in the sump is cold, that is below 20° C., the auxiliary pump 52 is switched on and the oil 18 is able to pass along pipes 14*a* and 14*b* and pipes 54*a* and 54*b* of the bypass loop 50 via the T-piece connector 15*a*. The oil 18 enters the auxiliary pump 52 at inlet 51 and is heated in the pump 52. The auxiliary pump 52 is hydraulically inefficient and therefore some of the oil 18 in the pump 52 remains in the pump 52 after one revolution or cycle of the pump 52. The mechanical movement of the oil 18 in the pump 52 increases the temperature of the oil 18 in the pump 52.

The warm oil 18 leaves the auxiliary pump 52 through outlet 53 passing along the pipe 54*b* towards the restriction 57. At the restriction 57, the oil 18 is forced through an aperture in the restriction 57 and continues along pipe 54*b* to the T-piece connector 15*b* and re-joins the main oil flow along pipe 14*a* from the sump 16 to the main oil pump 12. The warm oil 18 then enters the main oil pump 12 and is pumped out along pipe 14*b* to the engine 10. The warm oil 18 circulates around the engine 10 lubricating the moving parts (not shown) and warming the engine 10.

The warm oil 18 leaving pipe 54*b* and passing into T-piece 15*b* can also pass back along pipe 14*a* towards the sump 16. The main oil pump 12 preferentially draws warm oil from pipe 54*b* of the bypass 50 because the viscosity of the warm oil is less than that of the cold oil in pipe 14*a*. It is easier for the main pump 12 to draw and pump the less viscous oil in pipe 54*b*. Also the flow rate and therefore volume of oil from the auxiliary pump 52 is greater than the flow rate and therefore volume of oil from the main oil pump 12. When the auxiliary pump 52 is operating, the oil tends to move along pipe 14*a* to T-piece 15*a*, round the bypass loop 50 and through T-piece 15*b*, rather than flowing along pipe 14*c* between the two T-pieces 15*a* and 15*b*. The engine 10 is also a flow restriction in the same way as the restriction 57.

The electric motor 60 is powered by electricity stored in the vehicle battery 100. The vehicle battery 100 may be charged using the kinetic energy of the vehicle (not shown).

The restriction 57 is a section of pipe 54*b* having a circular aperture with a reduced internal diameter of 6 mm according to one exemplary embodiment. In comparison, the diameter of pipes 54*a* and 54*b* is 12 mm in this embodiment.

In an alternative embodiment the aperture may have an asymmetric shape. In a further alternative embodiment the aperture may be a cast section.

Some of the heat in the oil leaving the auxiliary pump 52 and entering the restriction 57 is transferred to the restriction 57. This heat loss is however minimal and in any case, the heat then stored in the restriction is transferred to new oil entering the restriction before it passes into the pipe 54*b* for delivery to the engine. The oil is a liquid and therefore there is minimal loss of heat due to the pressure drop between inlet and outlet sides of the restriction 57.

In FIGS. 1 to 4, the auxiliary pump 52 is in a bypass loop 50. This means that oil flow from the main oil pump 12 is unrestricted by the auxiliary pump 52. The auxiliary pump 52 may not be required to heat or pump the oil and so it is important the main oil pump 12 can continue to operate in isolation of the auxiliary pump 52.

Figure 2:
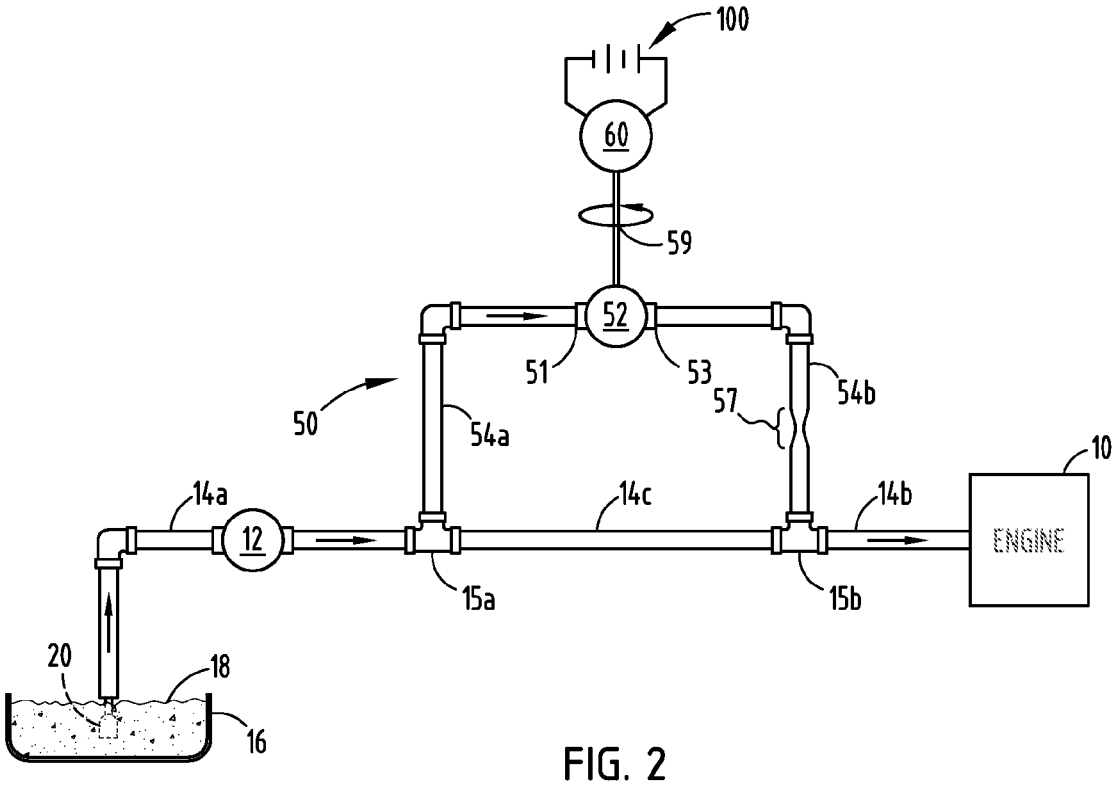
FIG. 2 is a schematic drawing of an alternative embodiment of the apparatus for heating a fluid with the auxiliary pump positioned after the main oil pump.

FIG. 2 shows an alternative apparatus for heating oil in a vehicle engine. The apparatus in FIG. 2 has many of the same features as the apparatus in FIG. 1. Where the features of the apparatus are the same, they have been given the same reference numerals. The apparatus in FIG. 2 differs from that in FIG. 1 by the position of the bypass loop 50. In the apparatus shown in FIG. 2, the bypass loop 50 is between the main oil pump 12 and the engine 10. In contrast, in apparatus shown in FIG. 1 the bypass loop 50 is between the sump 16 and the main oil pump 12.

The apparatus shown in FIG. 2 works in the same way as the apparatus shown in FIG. 1 and the oil 18 in the apparatus of FIG. 2 is heated by the auxiliary pump 52.

In contrast to the apparatus in FIG. 1, the auxiliary pump 52 of the apparatus in FIG. 2 is closer to the engine 10 and therefore the oil 18 entering the engine 10 is warmer than the oil 18 entering the engine 10 using the apparatus shown in FIG. 1. The warmer the oil 18 entering the engine 10 the more effective the oil 18 is at warming the engine 10 and the quicker the engine 10 will reach optimum operating temperature, that is typically from 90° C. to 110° C. The warm engine 10 is more fuel efficient and warm moving parts of the engine 10 are less susceptible to damage.

Figure 3:
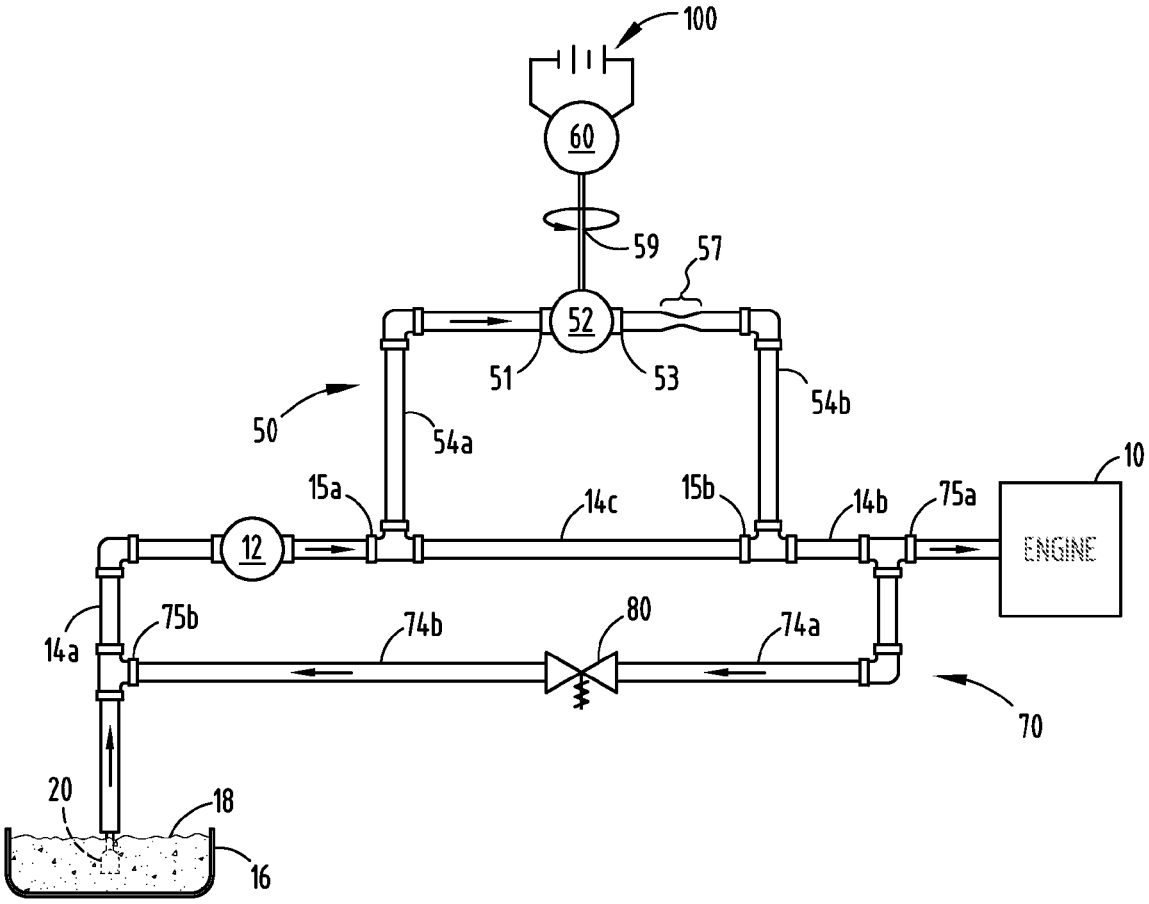
FIG. 3 is a schematic drawing of a further alternative embodiment of the apparatus for heating a fluid with the apparatus including a pressure relief valve.

FIG. 3 shows a schematic drawing of a further alternative apparatus for heating a fluid in accordance with another embodiment. The apparatus in FIG. 3 has the many of the same features as the apparatus in FIG. 2. Where the features of the apparatus are the same, they have been given the same reference numerals. The apparatus in FIG. 3 differs from that shown in FIG. 2 by the addition of a second bypass loop 70 with pressure relieve valve 80.

The second bypass loop 70 provides fluid communication between pipes 14*b* and 14*a* without the oil 18 passing through the main oil pump 12. Pipe 74*a* is connected to pipe 14*b* at T-piece 75*a*. Oil 18 can pass through the T-piece 75*a* and pipe 74*a* to the pressure relief valve 80. The oil pressure at which the pressure relief valve 80 opens can be adjusted but is normally set to open at 3 bar according to one embodiment. At this pressure the oil 18 is able to pass from the pipe 74*a*, through the pressure relief valve 80 and into pipe 74*b*. From pipe 74*b* the oil is able to return to the sump 16 through T-piece 75*b* and pipe 14*a*. When the pressure of the oil 18 in the pipes 14*b* and 74*a* is above 3 bar and the pressure relief valve 80 is therefore open, the direction of the flow of oil 18 in pipe 14*a* between the T-piece 75*b* and the sump 16 is towards the sump 16.

The pressure relief valve 80 ensures the oil pressure in the system, particularly in pipe 14*b* that supplies the engine 10 with oil, remains close to 3 bar, that is +/−1 bar. If the pressure of the oil supplied to the engine 10 exceeds a higher limit such as 6 bar, there is a risk that components (not shown) of the engine will be damaged.

Figure 4:
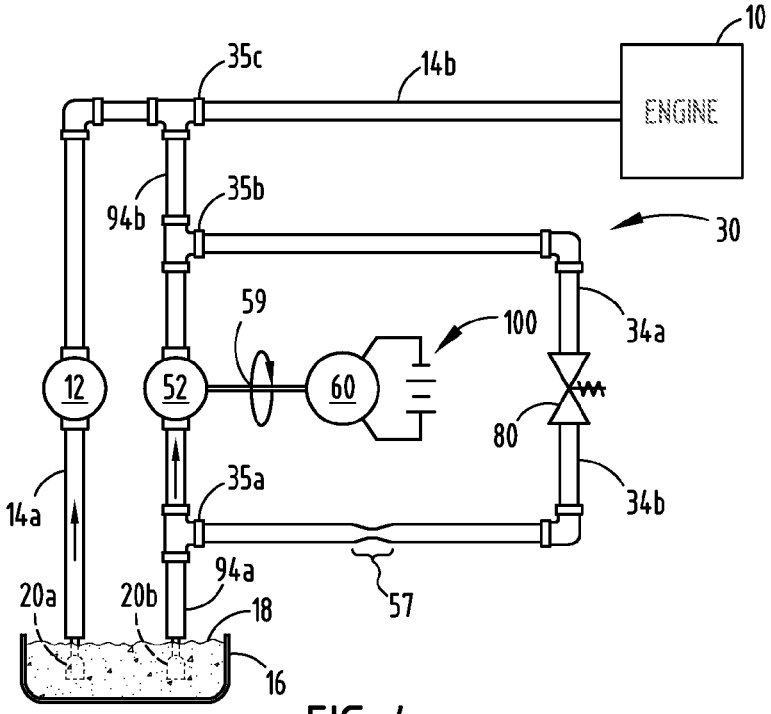
FIG. 4 is a schematic drawing of a yet further alternative embodiment of the apparatus for heating a fluid with the auxiliary pump and main oil pump in separate circuits.

FIG. 4 uses the auxiliary pump 52 to heat and pump the oil 18 around the engine 10. Some of the features of the apparatus in FIG. 4 are the same as those shown in FIGS. 1, 2 and 3. Where the features of the apparatus are the same, they have been given the same reference numerals. The apparatus in FIG. 4 differs from the apparatus shown in the earlier figures in that the main oil pump 12 and the auxiliary pump 52 have separate uptake pipes 14*a* and 94*a* that extend into the sump 16 and both the main oil pump 12 and the auxiliary pump 52 can be used to independently supply the engine 10 with oil 18. The pipes 14*a* and 94*a* have strainers 20*a* and 20*b* respectively.

The main oil pump 12 is not always required to circulate oil 18 around the engine 10 and the size of the main oil pump 12 is reduced to below the conventional minimum size of pump required for hot idle conditions. The oil flow for the main oil pump 12 can be controlled and the flow can be stopped so that all oil flow through the engine 10 is provided for by the auxiliary pump 52. The main oil pump 12 is hydraulically powered.

Under normal operating conditions the auxiliary pump 52 is used to both pump and heat the oil 18. In more extreme or demanding conditions the main oil pump 12 is used to supplement the oil flow from the auxiliary pump 52 to provide the engine 10 with the required oil flow rate and pressure.

The main oil pump 12 and auxiliary pump 52 are independent and can therefore be independently used to control the flow of oil 18 to the engine 10. The pipe 94*a* provides fluid communication between the sump 16 and the auxiliary pump 52. The pipe 94*b* provides fluid communication between the auxiliary pump 52 and pipe 14*b* that supplies the engine 10 with oil 18.

A bypass loop 30 provides fluid communication between pipes 94*b* and 94*a*, independent of the auxiliary pump 52. Pipe 34*a* of the bypass loop 30 connects the pipe 94*b* at a T-piece 35*b* with a pressure relief valve 80. Pipe 34*b* connects the pressure relief valve 80 with the pipe 94*a* at a T-piece 35*a*. The pipe 34*b* has a restriction 37 with an aperture that restricts the flow of oil along the pipe 34*b*.

The engine 10 is a flow restriction and so in use, oil 18 tends to flow around the bypass loop 30 rather than passing along the pipe 94*b* to the T-piece 35*c*. In use, the auxiliary pump 52 draws warm oil from pipe 34*b* and cool oil 18 from the sump 16. A portion of the oil that has been warmed by the auxiliary pump 52 is pumped along pipe 94*b*, through the T-pieces 35*b* and 35*c* and into pipe 14*b* for supply to the engine 10. The remaining portion of the oil that has been warmed by the auxiliary pump 52 will be pumped through T-piece 35*b* and into pipe 34*a* for circulation around the bypass loop 30.

An electrical energy management system (not shown) is used to control and/or manage the storage and use of electrical energy generated by the engine 10. The electrical energy management system (not shown) maximizes the benefit(s) that can be gained from any excess of electrical energy that is generated by the engine 10. For example, any excess electrical energy is used to power the auxiliary pump 52 that is pumping and/or heating the oil 18. This means that when there is an excess of electrical energy, the main oil pump 12 is stopped and the power and therefore fuel consumed by engine to run the main oil pump 12 is saved.

Improvements and modifications may be made to the apparatus shown in FIGS. 1 to 4 without departing from the scope of the invention. For example, the relative sizes of the main oil pump 12 and auxiliary pump 52 may be adapted to suit a particular engine size or design.

It is to be understood that variations and modifications can be made on the aforementioned structure without departing from the concepts of the present invention, and further it is to be understood that such concepts are intended to be covered by the following claims unless these claims by their language expressly state otherwise.

What is claimed is:

1. An apparatus for heating a fluid, comprising:

an oil pump and an auxiliary pump both drawing fluid from a common reservoir;

a conduit connected to the auxiliary pump and providing fluid communication from the auxiliary pump; and an aperture in the conduit;

wherein in use the auxiliary pump contains the fluid, a first portion of the fluid is pumped into the conduit by the auxiliary pump and a second portion of the fluid remains in the auxiliary pump, the aperture restricting the flow of the first portion of the fluid in the conduit, and wherein the second portion of the fluid is heated due to friction between the second portion of the fluid and the auxiliary pump.

2. The apparatus according to claim 1, wherein the apparatus is part of an internal combustion engine.

3. The apparatus according to claim 2, wherein the fluid is engine oil for circulating in the internal combustion engine.

4. The apparatus according to claim 3, wherein the auxiliary pump has a variable displacement, such that the volume of engine oil displaced by the auxiliary pump per unit time can be changed.

5. The apparatus according to claim 1, wherein in use the auxiliary pump circulates the engine oil in the internal combustion engine.

6. The apparatus according to claim 1, wherein the auxiliary pump is powered by an electric motor.

7. The apparatus according to claim 1, wherein the oil pump has a variable displacement, such that the volume of engine oil displaced by the oil pump per unit time can be changed.

8. The apparatus according to claim 1, wherein the oil pump is off while the volume of engine oil displaced by the auxiliary pump is from 5 to 200 l/min.

9. The apparatus according to claim 1, wherein the aperture has an opening with an internal diameter of from 10 to 20 mm.

10. The apparatus according to claim 1, further comprising:

a first strainer coupled to a first uptake pipe directing fluid to the oil pump; and a second strainer coupled to a second uptake pipe directing fluid to the auxiliary pump.

11. An apparatus for heating engine oil circulating in an engine comprising:

a primary pump;

an auxiliary pump;

a conduit creating a bypass loop for the auxiliary pump and comprising a fluid restrictor, wherein the bypass loop is disposed between the primary pump and the engine; and engine oil pumped by the auxiliary pump such that a first portion pumps through the bypass loop and a second portion remains in the auxiliary pump and is heated.

12. The apparatus according to claim 11, wherein the engine is an internal combustion engine that comprises an oil pump for circulating the engine oil in the internal combustion engine.

13. The apparatus according to claim 11, wherein the auxiliary pump circulates the engine oil in the internal combustion engine.

14. The apparatus according to claim 11, wherein the auxiliary pump is powered by an electric motor.

15. The apparatus according to claim 11, wherein the restrictor comprises a fixed reduced diameter aperture within the conduit.

16. The apparatus according to claim 11, wherein the oil pump and auxiliary pump are configured to supply oil to the engine independently.

17. A method of heating a fluid, comprising:

supplying the fluid to an oil pump and an auxiliary pump from a common reservoir;

pumping a first portion of the fluid into a conduit having an aperture restricting flow of the first portion of the fluid in the conduit; and circulating a second portion of the fluid that remains in the auxiliary pump because the aperture restricts the flow of the first portion of the fluid in the conduit;

wherein the second portion of the fluid is heated in the auxiliary pump due to friction between the second portion of the fluid and the auxiliary pump.

18. The method according to claim 17, wherein the fluid supplied to the auxiliary pump is engine oil in an internal combustion engine.

19. The method according to claim 17, wherein the auxiliary pump discharges a greater volume of engine oil per unit time compared to the oil pump.

20. The method according to claim 17, wherein the aperture restricting the flow of the first portion of the fluid in the conduit provides the auxiliary pump with work to do.

* * * * *